US005215492A

United States Patent [19]

Kubiatowicz

[11] Patent Number: 5,215,492

[45] Date of Patent: Jun. 1, 1993

[54] TOY BALLOON WITH COOL ILLUMINATION

[76] Inventor: James F. Kubiatowicz, 1630 NE. Rice Creek Rd., Fridley, Minn. 55432

[21] Appl. No.: 725,980

[22] Filed: Jul. 5, 1991

Related U.S. Application Data

[63] Continuation-in-part of Ser. No. 386,899, Jul. 28, 1989, abandoned.

[51] Int. Cl.[5] ..... A63H 27/10

[52] U.S. Cl. ..... 446/219; 446/220; 362/34; 362/253

[58] Field of Search ..... 446/220, 219, 221, 222, 446/224; 40/214; 362/34, 363, 253, 806, 352; 116/210, DIG. 8, DIG. 9

[56] References Cited

U.S. PATENT DOCUMENTS

| | | | |
|---|---|---|---|
| 716,645 | 12/1902 | Rahson | 273/DIG. 24 |
| 827,350 | 7/1906 | Crofford | 446/219 |
| 1,471,886 | 10/1923 | Dessau | 446/220 |
| 1,530,923 | 3/1925 | Anns | 446/224 |
| 2,383,390 | 8/1945 | Jacobs | 446/220 X |
| 2,463,517 | 3/1949 | Chromak | 446/220 X |
| 2,646,019 | 7/1953 | Chetlan | 116/114 |
| 3,114,717 | 12/1963 | Wyman et al. | 252/374 |
| 3,536,906 | 10/1970 | Bloom . | |
| 3,539,794 | 11/1970 | Rauhut et al. | 362/34 |
| 3,578,962 | 5/1971 | Gerber | 362/34 |
| 3,751,846 | 8/1973 | Benjamin | 362/34 X |
| 3,774,022 | 11/1973 | Dubrow | 362/34 |
| 3,800,132 | 3/1974 | Postal | 362/34 |
| 4,015,111 | 3/1977 | Spector | 362/34 |
| 4,479,649 | 10/1984 | Newcomb et al. | 273/61 |
| 4,586,456 | 5/1986 | Forward | 446/220 X |
| 4,717,158 | 1/1988 | Pennisi | 273/58 |
| 4,787,575 | 11/1988 | Stewart | 116/210 X |
| 4,934,986 | 6/1990 | Wallace | 446/222 |

FOREIGN PATENT DOCUMENTS

| | | | |
|---|---|---|---|
| 572581 | 3/1959 | Canada | 446/221 |
| 525715 | 5/1931 | Fed. Rep. of Germany | 446/220 |
| 411175 | 6/1910 | France | 40/214 |

OTHER PUBLICATIONS

American Cyanamid Co. brochure No. N20-87A, copyrighted 1987, 1 page.

*Primary Examiner*—Mickey Yu

*Attorney, Agent, or Firm*—William L. Huebsch

[57] ABSTRACT

A toy balloon in or on which is attached at a predetermined position a light source structure capable of emitting light without generating a significant amount of heat. The light source structure can include a light stick over which is positioned a translucent envelope having a predetermined decorative peripheral shape; or a length of transparent or translucent small diameter flexible polymeric tubing having a central passageway in which mixed chemical substances are reacting to emit visible light, with the tubing extending around, through, or away from the outlet opening of the balloon.

7 Claims, 4 Drawing Sheets

TOY BALLOON WITH COOL ILLUMINATION

RELATED APPLICATION

This application is a continuation in part of U.S. patent application No. 07/386,899 filed July 28, 1989, abandoned, the content whereof is incorporated herein by reference.

TECHNICAL FIELD

The present invention relates to toy balloons and means for providing light within or adjacent such a balloon for amusement or other purposes when the balloon is inflated.

BACKGROUND ART

The use of lights in association with balloons is well known. U.S. Pat. Nos. 1,530,923, 3,536,906, 4,586,456 and 4,787,575 and German Patent No. 525,715 provide illustrative examples. Also, the use of phosphorescent materials or light sticks that produce light by chemical reaction in balls, balloon like structures, or balloons has been described, illustrative examples being U.S. Pat. Nos. 716,645, 3,800,132, 4,717,158, 4,015,111 and 4,479,649 and a 1987 publication No. N20-87A by American Cyanamid Company, Wayne, N.J. that describes the use of light sticks American Cyanamid Company sells under the trade designation "Cyalume Lightstick" as a light emitting source on or within a toy balloon by either tying one end of a light stick to the inlet portion of the balloon so that it dangles below the balloon, or inserting the light stick into the balloon so that the balloon can be manually gyrated to cause the light stick to move about its inner surface.

DISCLOSURE OF INVENTION

The present invention affords novel means for positioning a light source structure capable of emitting light without generating a significant amount of heat in or on a toy balloon at predetermined position with respect to the balloon such as generally centrally in or along a diametrical line through its cavity, and also affords different shaped light source structures in and/or on balloons to provide striking and pleasing visual lighting effects for balloons used, for example, at parties or carnivals.

According to the present invention there is provided the combination of (1) a toy balloon of the type comprising a thin flexible wall (which wall may or may not be transparent or translucent and/or resiliently stretchable) having an inner surface defining a cavity and including an inlet portion defining a through inlet opening into the cavity through which gas under pressure can be directed into the cavity to inflate the balloon; (2) a light source structure capable of emitting light without generating a significant amount of heat; and (3) means for attaching the light source structure to the wall of the balloon to support the light source structure generally at a predetermined position with respect to the cavity, such as centrally or projecting or extending diametrically within the cavity or projecting away from the outer surface of the balloon.

The light source structure may comprise a light emitting member or light stick of the type described above that is commercially available from American Cyanamid Company, Wayne, N.J. under the trade designation "Cyalume Lightstick", is described in U.S. Pat. Nos. 3,576,987 and 3,597,362, (the content whereof are incorporated herein by reference), and generally comprises a stiff polymeric housing defining a plurality of cavities, a plurality of chemical substances within the cavities which upon being mixed together will react to emit visible light, and means for affording mixing of the chemical substances within the cavities initiated by manual manipulation of the housing, such as bending of the light stick housing until a glass wall defining one of the cavities ruptures. Alternatively, the light emitting member may comprise a polymeric housing in which the chemical substances of the light sticks described in those U.S. Pat. Nos. 3,576,987 and 3,597,362 have been mixed together so that they are reacting to emit light (whereupon their reaction to produce light typically is slowed by cooling until the light source structure is used with the balloon) which housing may be a length of stiff polymeric tubing, or a length of very flexible transparent or translucent polymeric tubing having a central passageway (e.g., tubing of 0.05 inch outside diameter and 0.03 inch inside diameter or smaller) in which the chemical substances are sealed; or may comprise a phosphorescent material of a known type in a stiff or flexible polymeric binder or housing that will cause luminescence upon absorption of visible light and will continue such luminescence for a noticeable time after exposure to visible light has ceased.

Means for attaching the light source structure to the wall of the balloon to support the light source structure generally at a predetermined position with respect to its wall (i.e., inside or inside, outside, or inside and outside of the balloon) can include, the wall of the balloon having a portion defining a socket opening along its inner surface adapted to frictionally receive a portion of the light source structure. Alternatively, that means may include a first end of the light source structure adapted to be attached to the wall of the balloon (e.g., by being adhered thereto or having a portion of the wall bound around a head or ball defining its first end) from which the light source structure is supported.

In some embodiments, the light source structure includes a light emitting member or light stick, a translucent envelope having a predetermined decorative peripheral shape and a cavity within the envelope adapted to receive the light emitting member, and means for retaining the light emitting member within the cavity; and the means for attaching attaches the light source structure to the wall of the balloon to support the light source structure generally at a predetermined position in the cavity with respect to the wall when the balloon is inflated. That means for attaching can be provided by a resiliently elastic elongate member (e.g., a rubber band) adapted to be attached so that it extends transverse of the cavity of the balloon to support the light source structure therein, or a post having one end attached to the wall at a position generally opposite the inlet opening, and supporting the light stick and translucent envelope from adjacent its opposite end.

In other embodiments the light source structure comprises a length of small very flexible transparent or translucent polymeric tubing having a plurality of chemical substances sealed within a central passageway which have been mixed together and are reacting to emit visible light, and the means for attaching may attach a portion of the tubing to the wall of the balloon at its inlet portion and may attach a first end of the tubing along the inner or outer surface of the balloon wall generally opposite its inlet opening with the tubing extending around the outer surface of the wall or along a diametrical path centrally through the cavity to or through the outlet opening of the inflated balloon. An end portion of the tubing may extend from the outlet opening outside of the balloon to serve as a string by which the balloon may be held or tied to a structure. Alternatively the first end of this light source structure may be attached to the inlet portion of an inflated balloon to serve as a string by which the balloon may be held or tied to a structure, and the balloon may or may not contain a second light source structure such as of the type described in the preceding paragraph.

At sea level one cubic foot of helium gas commonly used to inflate balloons can lift about one ounce of weight at room temperature. Thus the balloon, the light source structure or structures, and the means for attaching the light source structure should have a weight of less than one ounce per cubic foot of area in the cavity of the inflated balloon, which is possible using the light source structures and means for attachment described above.

Also, the visual effect of any of the light source structures used inside of a balloon can be enhanced by lightly coating the inside surface of the balloon with powdered phosphorescent material.

BRIEF DESCRIPTION OF DRAWING

The present invention will be further described with reference to the accompanying drawing wherein like reference numerals refer to like parts in the several views, and wherein.

DETAILED DESCRIPTION

Figure 2:
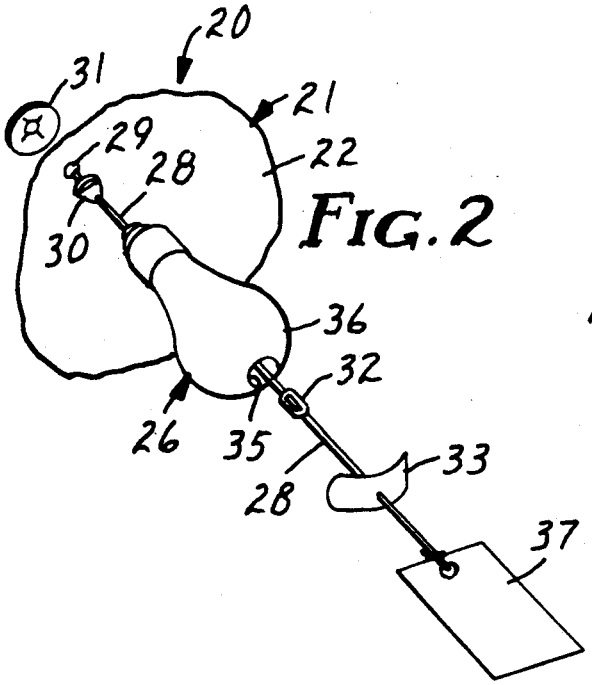
FIG. 2 is a reduced perspective view of the combination shown in FIG. 1 before it is assembled with a major portion of the balloon broken away to show detail.
Figure 1:
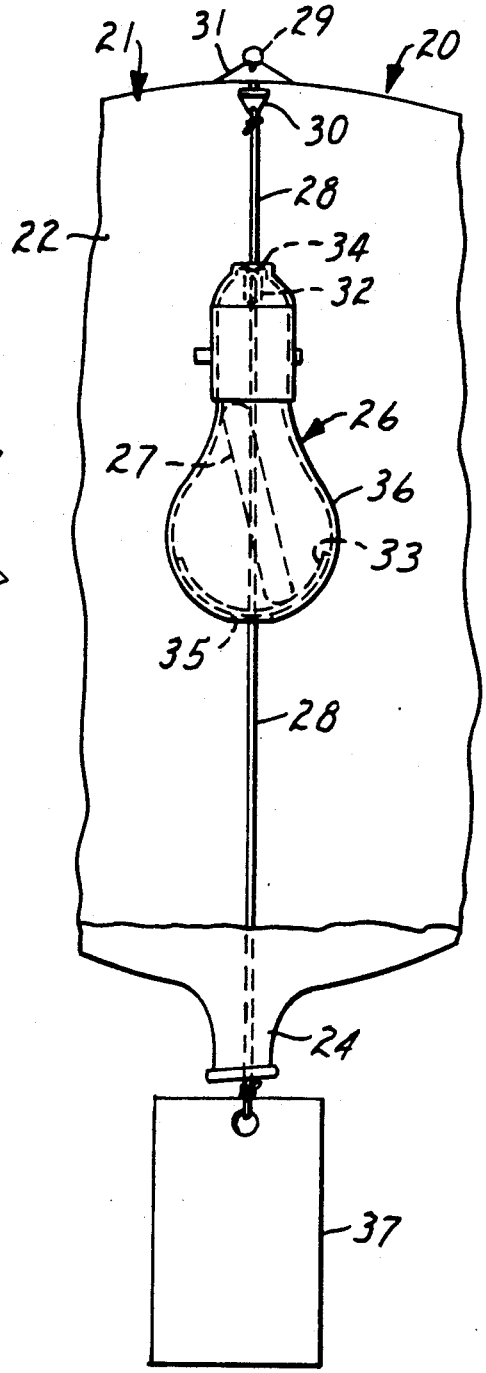
FIG. 1 is a side view of a first embodiment of a combination according to the present invention comprising a toy balloon and a light source structure shown assembled for use and having a portion of the balloon broken away to show detail.
Figure 3:
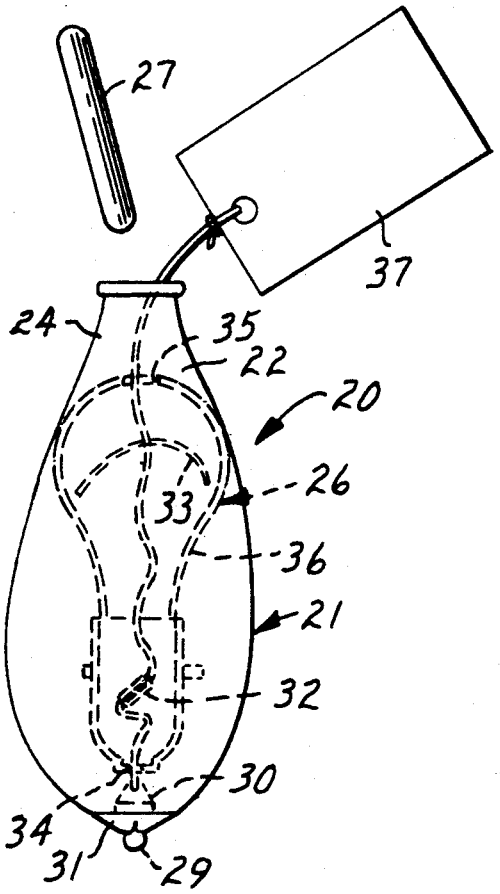
FIG. 3 is a side view of the combination shown in FIG. 1 before the balloon is inflated.

Referring now to FIGS. 1, 2, and 3 of the drawing, there is shown a first embodiment of a combination according to the present invention generally designated by the reference numeral 20.

Generally the combination 20 includes (1) a toy balloon 21 comprising a thin flexible transparent or translucent wall 22 (which may be made of a polymeric material or of a resiliently stretchable material such as latex rubber), which wall 22 has an inner surface defining a cavity and includes an inlet portion 24 adapted to be tied closed (or alternatively to be closed by a closure assembly 223 of the type illustrated and described with reference to the embodiment of FIGS. 4, 5 and 6), which inlet portion 24 defines a through inlet opening into the cavity through which gas under pressure can be directed into the cavity to inflate the balloon 21; (2) a light source structure 26 comprising a decorative envelope 36 of translucent polymeric material (e.g., polyethylene) illustrated as having the peripheral shape of a conventional electric light bulb in a socket (but which could have any other desired predetermined decorative peripheral shape such as that of a star, globe, or a symbol representing a group or organization) and a light emitting member or stick 27 within a cavity in the decorative envelope 36 that is capable of emitting visible light without the production of significant heat and which may have any of the known structures for such light emitting members described above, but which for this application is preferably the light stick commercially available from American Cyanamid Company, Wayne, N.J. 07470 under the trade designation "50 millimeter Cyalume Lightstick"; and (3) means for supporting the light source structure 26 from the wall 22 of the balloon 21 generally at a predetermined position within the cavity (e.g., generally centrally as illustrated).

The means for supporting the light source structure 26 from the wall 22 comprises an elongate resiliently elastic support member 28 (e.g., a rubber band) having first and second ends and a length at least adapted to extend transverse of the cavity in the balloon 21 when the balloon 21 is inflated, and means for attaching the first end of the elastic support member 28 to the wall 22 of the balloon 21 at a location opposite its inlet portion 24 including an attachment member 30 to which one end of the elastic support member 28 is tied, and a flexible frustoconical retaining washer 31. The attachment member 30 includes a spherical head 29 having a diameter (e.g., ¼ inch) larger than the adjacent portion of the attachment member 30, and the flexible frustoconical retaining washer 31 has a central opening smaller than the head 29 and spaced slits radially extending from the opening that allow the portions of the washer 31 projecting toward that central opening to resiliently deflect around a portion of the balloon wall 22 disposed around the head 29 and retain the head 29 within that portion of the balloon wall 22. The light bulb in socket shaped decorative envelope 36 is a thin walled blow molded structure having a small first or upper opening 34 at its upper end that is only slightly larger than the transverse area of the elastic support member 28, and a larger second or bottom opening 35 at its bottom end through which the light stick 27 is inserted. The means for supporting the light source structure 26 from the wall 22 further includes an elongate retaining member 32 of a size that will not pass through the first opening 34 in the upper end of the decorative envelope 36 attached along the elastic support member 28 as by having the elastic support member threaded transversely through it at spaced locations along its length. The elastic support member 28 passes through the first and second openings 34 and 35 and the cavity of the decorative envelope 36 and the retaining member 32 is positioned in that cavity so that the upper end of the decorative envelope 36 will be supported against the uppermost end of the retaining member 32 when the balloon is oriented with the first end of the elastic support member 28 uppermost (FIG. 1).

A portion of the elastic support member 28 passes through the inlet portion 24 of the balloon 21, and the second end of the elastic support member 28 is tied to an object 37 (e.g., a card on which instructions for using the combination 20 are printed) that can not pass through the inlet portion 24. After the balloon 21 is inflated a portion of the elastic support member 28 is retained in the inlet portion 24 by that inlet portion 24 being manually tied closed (or by the closure assembly 223 being tightened around it) with the portion of the elastic support member 28 between the inlet portion 24 and the attachment member 30 under tension. Subsequently should the balloon become slightly deflated during use (e.g., as by helium escaping through its wall 22), that portion of the elastic support member 28 under tension between the inlet portion 24 and the attachment member 30 will shorten proportionately on both sides of the light source structure 26 and will remain under tension to properly support the light source structure 26 generally in the central portion of the balloon 21.

The light source structure also includes means for affording insertion of the light stick 27 into the decorative envelope 36 through its second or lower opening 35 and for retaining the light stick 27 within the cavity in the decorative envelope 36 after it is inserted therein. An elongate arcuate resiliently flexible transparent polymeric retaining sheet 33 (e.g., of acetate film) has a central opening through which the elastic support member 28 is threaded, and is positioned within the cavity in the decorative envelope 36 over its bottom opening 35. The retaining sheet 33 interacts with the decorative envelope 36, the elastic support member and the retaining member 32 to provide the means for allowing insertion of the light stick 27 into the decorative envelope 36 and for subsequently retaining the light stick 27 therein as will further be described below.

The combination 20 is supplied to a user such as a balloon vendor in the form illustrated in FIG. 3 with the balloon 21 in an non inflated condition, the elastic support member 28 having its first end attached to the wall 22 of the balloon 21 at a location opposite the inlet portion 24 of the balloon 21 by the attachment member 30 and the washer 31, the decorative envelope 36 within the cavity of the uninflated balloon 21, and the elastic support member 28 in an unstretched condition and extending through the first and second openings 34 and 35 and the cavity of the decorative envelope 36 and out the inlet portion 24 of the balloon 21 with the retaining member 32 and retaining sheet 33 positioned within the cavity in the decorative envelope 36. When the user wishes to use the combination 20, he takes a light stick 27 that has not been activated to emit light, bends the light stick 27 to cause it to emit light, and inserts the light stick 27 endwise through the inlet portion 24 of the balloon 21 into the second or bottom opening 35 in the decorative envelope 36. The user then pulls on the end portion of the elastic support member 28 extending outwardly from the inlet portion 24 of the balloon 21 so that the retaining member 32 engages, pulls and deflects the retaining sheet 33 past the side of the light stick 27 in the decorative envelope 36 to position the retaining sheet 33 over the bottom opening 35 on the inside of the decorative envelope 36. The user then inflates the balloon 21 as with helium through the inlet portion 24, applies tension to the elastic support member 28, and closes the opening in the inlet portion 24 of the balloon 21 by manually tying it (or using the closure assembly 223). Gravity will then cause the envelope 36 to slide to a position with it upper end supported on the upper surface of the retaining member 32 in the floating balloon 21, and the combination 20 in subdued light will give the pleasing appearance of a lighted electric light bulb in the inflated balloon 21.

Figure 6:
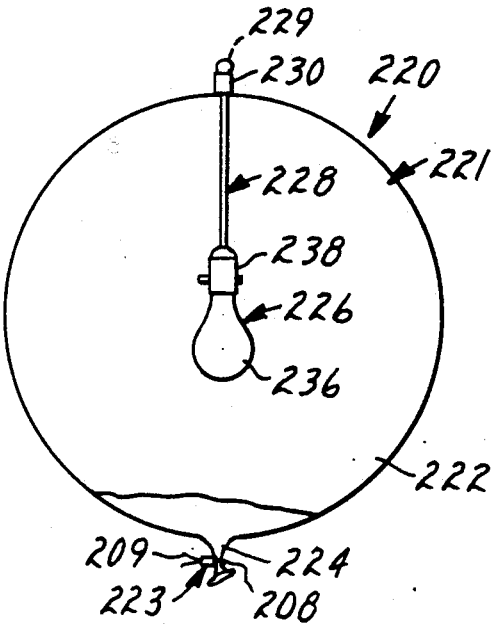
FIG. 6 is a reduced side view of a total assembly of the combination shown in FIG. 4 with a portion of the balloon broken away to show detail.
Figure 5:
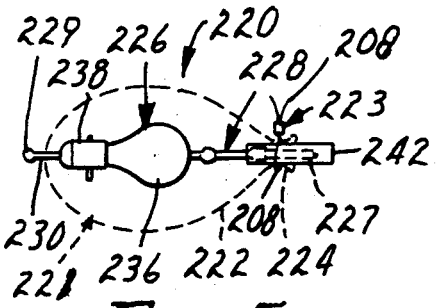
FIG. 5 is a reduced side view of a partial assembly of the combination shown in FIG. 4 with the balloon shown in dotted outline.
Figure 4:
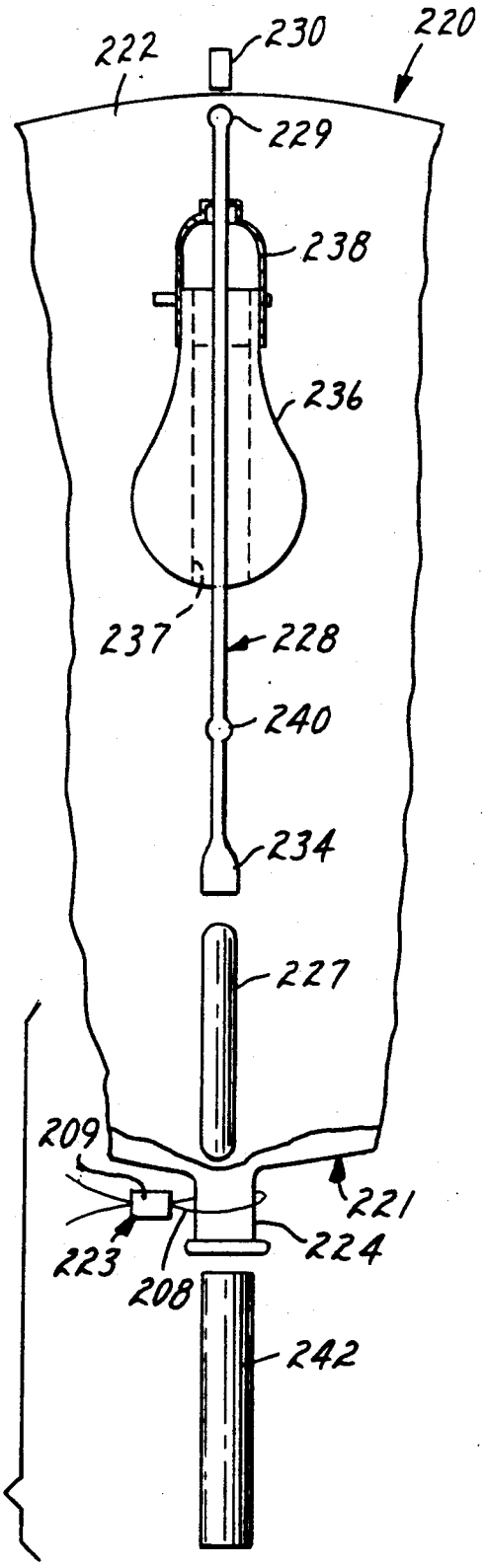
FIG. 4 is a side view of a second embodiment of a combination according to the present invention comprising a toy balloon and a light source structure shown disassembled and having a portion of the balloon broken away to show detail.

Referring now to FIGS. 4, 5, and 6 of the drawing, there is shown a second embodiment of a combination according to the present invention generally designated by the reference numeral 220.

Generally the combination 220 comprises a toy balloon 221 comprising a thin flexible transparent or translucent wall 222 (which may be made of a polymeric material or of a resiliently stretchable material), which wall 222 has an inner surface defining a cavity and includes an inlet portion 224 that can be closed by manually tying it shut or by using a closure assembly 223 illustrated, which inlet portion 224 defines a through inlet opening into the cavity through which gas under pressure can be directed into the cavity to inflate the balloon 221; a light source structure 226 comprising a light stick 227 having a stiff housing that is capable of emitting visible light without the production of significant heat and which may have any of the known structures for such a light source structure described above, but which for this application is preferably the light stick commercially available from American Cyanamid Company, Wayne, N.J. 07470 under the trade designation "Cyalume Lightstick"; and means for supporting the light source structure 226 from the wall 222 of the balloon 221 generally at a predetermined position within the cavity (e.g., generally centrally and extending diametrically as illustrated). The means for supporting the light source structure 226 from the wall 222 comprises a support member or post 228 having first and second ends, means for attaching the first end of the post 228 to the wall 222 including a head 229 having a diameter (e.g., ¼ inch) larger than the adjacent portion of the post 228 at the first end and an elastic band 230 which is preferably a ¼ inch long length of polyvinyl chloride tubing having a 0.08 inch inside diameter and an 0.125 inch outside diameter, and means for attaching the light source structure 226 at the second end of the post 228. The head 229 is positioned adjacent the inner surface of the wall 222 at a portion of the wall 222 generally opposite the inlet portion 224 as illustrated; and the band 230 is engaged around the outer surface of that portion of the balloon wall 222 and the portion of the post 228 adjacent the head 229 to attach the head 229 to the wall 222 so that upon a predetermined amount of inflation of the balloon 221 as illustrated, the post 228 will position the light source structure 226 generally at the predetermined position within the cavity. The stiff housing of the light stick 227 has a generally cylindrical peripheral portion adjacent one end, and the means for attaching the light source structure 226 at the second end of the post 228 comprises the post 228 having a an axially aligned cylindrical wall 234 defining a socket opening through the second end of the post 228 and adapted to frictionally engage the cylindrical peripheral portion of the housing of the light stick 227 to position the light stick 227 projecting coaxially from the post 228. The light source structure 226 also includes a shaped envelope 236 of a highly translucent polymeric material (e.g., expanded polystyrene) illustrated as having the peripheral shape of a conventional electric light bulb, but which could have any other desired predetermined decorative peripheral shape. The shaped envelope 236 has a through bore 237 of a diameter and length adapted to receive the light stick 227, and has one end fixed in a collar 238 of a stiff opaque plastic in the shape of a conventional switched light socket and having an opening smaller than the bore 237 at its end opposite the envelope 236. The collar 238 and envelope 236 are positioned around a portion of the post 228 between its first and second ends, and are axially slidable along the post 228 from a spaced position spaced from the cylindrical wall 234 to afford manually inserting a light stick 227 therein and manual bending the light stick 227 to cause it to emit light, to an enclosing position with the envelope 236 around the light stick 227 then positioned in the bore 237, which enclosing position is determined by engagement of the collar 238 with an enlarged stop portion 240 along the post 228.

The closure assembly 223 comprises a length of balloon cord 208 having a central portion passing around the inlet portion 224 of the balloon 221, and end portions passing through a short length 209 of hollow polymeric tubing that fits closely around the cord 208 (e.g., a 1/16 inch inside diameter, ⅛ inch outside diameter, ⅜ inch long length of polyvinyl chloride tubing). When the end portions of the cord 208 are pulled through the length 209 of tubing, the central portion of the cord 208 and adjacent end of the length 209 of tubing will squeeze the inlet portion 224 of the balloon 221 to close its inlet opening, and will be held in that position by friction between the cord 208 and the length 209 of tubing.

For use, preferably their is supplied to a balloon vendor the combination illustrated in FIG. 5 of the balloon 221 in an non inflated condition, the post 228 having its first end attached to the wall 222 of the balloon 221 opposite its inlet portion 224 by the band 230, the collar 238 and envelope 236 assembly being in their spaced position along the post 228, and a light stick 227 that has not been activated to emit light frictionally engaged in and projecting from the cylindrical wall 234 into a hollow cylindrical fill tube 242 frictionally engaged in the expanded inlet portion 224 of the balloon 221. When the balloon 221 is to be used, the vendor bends the light stick 227 to cause it to emit light, inflates the balloon 221 as with helium through the fill tube 242, after which the fill tube 242 is withdrawn and the inlet opening of the balloon 221 is closed by the closure assembly 223. Gravity will then cause the collar 238 and envelope 236 to slide to their enclosing position determined by engagement of the collar 238 with the stop portion 240 of the post 228 in the floating balloon 221, and the assembly in subdued light will give the appearance of a lighted electric light bulb in the inflated balloon 221 as is illustrated in FIG. 6.

Figures 7, 8, 9:
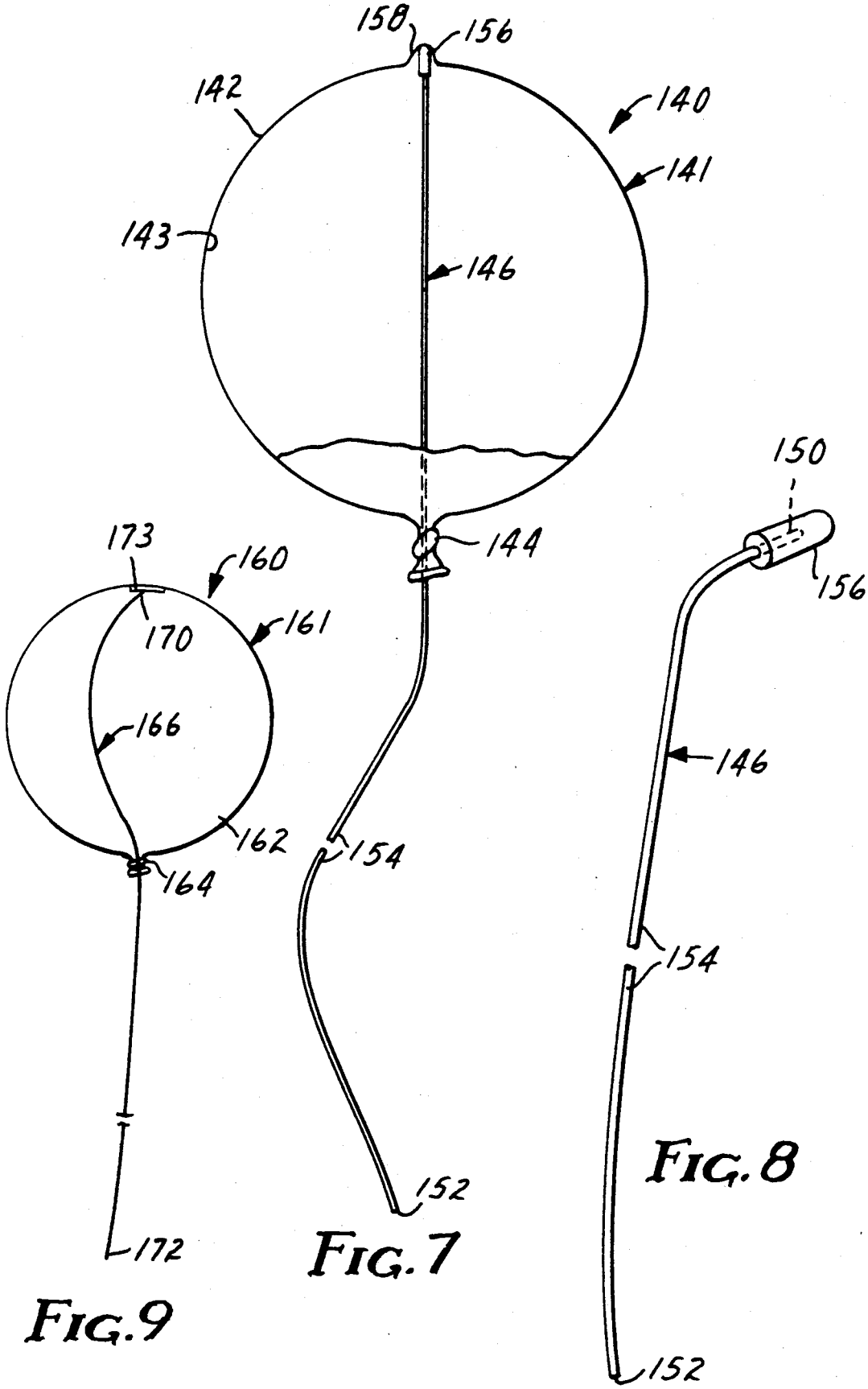
FIG. 7 is a side view of an third embodiment of a combination according to the present invention comprising a toy balloon and a light source structure and having a portion of the balloon broken away to show detail.
FIG. 8 is a perspective fragmentary view of the light source structure and part of means for attaching the light source structure to the balloon in the embodiment of FIG. 7.
FIG. 9 is a side view of a fourth embodiment of a combination according to the present invention comprising a toy balloon and a light source structure.

Referring now to FIGS. 7 and 8 of the drawing, there is shown an third embodiment of a combination according to the present invention generally designated by the reference numeral 140.

Generally the combination 140 comprises a toy balloon 141 comprising a thin transparent or translucent flexible resiliently stretchable wall 142 having an inner surface 143 defining a cavity and including an inlet portion 144 illustrated tied in a knot to close the cavity, which inlet portion 144 defines a through inlet opening into the cavity through which gas (e.g., helium) under pressure can be directed into the cavity to inflate the balloon 141; a light source structure 146 which is capable of emitting visible light without the production of significant heat; and means for attaching the light source structure 146 to the wall 142 to support the light source structure 146 generally at a predetermined position with respect to the wall 142. The light source structure 146 is a length of small diameter flexible transparent polymeric tubing (e.g., 0.05 inch outside diameter, 0.03 inch inside diameter extruded polyvinyl chloride tubing) having first and second ends 150 and 152, a central passageway, and a plurality of the chemical substances described above sealed within the central passageway (e.g., by heat sealing at the ends of the tubing) which chemical substances have been mixed together and are reacting to emit visible light. The means for attaching attach the first end 151 of the tubing to the wall 142 of the balloon 141 along its inner surface 143 generally opposite the inlet opening, and a portion of the light source structure 146 extends from that portion of the means for attaching generally diametrically through the cavity and through the outlet opening of the inflated balloon 141. The outlet opening of the balloon 141 is closed around a portion of the tubing to provide an addition portion of the means for attaching, and a major end portion 154 of the light source structure 146 adjacent its second end 152 extends radially outside of the cavity in the balloon 141 and serves as a string by which the balloon 141 may be held or tied to a structure.

As illustrated in FIGS. 7 and 8, the portion of the means for attaching that attaches the first end 150 of the tubing to the wall 142 of the balloon 141 comprises a support member 156 attached at the first end 150 of the tubing by an end portion of the tubing being adhered in a socket in the support member 156; and the wall 142 of the balloon 141 being resiliently stretchable and including a socket portion 158 generally opposite the inlet opening defining a socket opening along the inner surface 143 adapted to frictionally receive the support member 156, with the socket portion 158 being retained upon a predetermined amount of inflation of the balloon 141. Alternatively, the support member could have a transverse surface which could be adhered to the inner surface of the balloon wall by a layer of adhesive, or a head similar to the head 229 illustrated in FIGS. 4, 5 and 6 which could be positioned adjacent the inner surface of a portion of the balloon wall and attached thereto by a band engaged around that portion of the balloon wall and a smaller adjacent portion of the support member to attach the head to the balloon wall.

A light source structure in the form of a length (e.g., five feet) of small diameter flexible transparent polymeric tubing (e.g., 0.05 inch outside diameter, 0.03 inch inside diameter extruded poly vinyl chloride tubing)

having a central passageway, and a plurality of the chemical substances described above sealed within the central passageway (e.g., by heat sealing at the ends of the tubing) which chemical substances have been mixed together and are reacting to emit visible light, can also be used as strings for holding or tethering the other structures described above with reference to FIGS. 1–3 and 4–6, as well as being attached to an inflated toy balloon that does not contain a light source structure.

Referring now to FIG. 9 of the drawing, there is shown a forth embodiment of a combination according to the present invention generally designated by the reference numeral 160.

Generally the combination 160 comprises a toy balloon 161 comprising a thin transparent or translucent flexible resiliently stretchable wall 162 having an inner surface defining a cavity and including an inlet portion 164 illustrated tied in a knot to close the cavity, which inlet portion 164 defines a through inlet opening into the cavity through which gas (e.g., helium) under pressure can be directed into the cavity to inflate the balloon 161; a light source structure 166 which is capable of emitting visible light without the production of significant heat; and means attaching the light source structure 166 to the wall 162 to support the light source structure 166 generally at a predetermined position relative to the wall 162. The light source structure 166 comprises a length of transparent or translucent small diameter flexible polymeric tubing (e.g., 0.05 inch outside diameter, 0.03 inch inside diameter extruded poly vinyl chloride tubing) having first and second ends 170 and 172, a central passageway, and a plurality of the chemical substances described above sealed within the central passageway (e.g., by heat sealing at the ends of the tubing) which chemical substances have been mixed together and are reacting to emit visible light. The means for attaching includes a length 173 of pressure sensitive adhesive coated tape attaching the first end 171 of the tubing to the wall 162 of the balloon 161 along its outer surface 163 at a position generally opposite the inlet opening with a portion of the light source structure 166 extending from that portion of the means for attaching around the outer surface of the balloon 161 to the inlet portion 164 of the inflated balloon 161 to which it is also attached as by a cord. A major end portion of the light source structure 166 adjacent its second end 172 extends generally radially away from the balloon 161 and serves as a string by which the balloon 161 may be held or tied to a structure.

Figure 11:
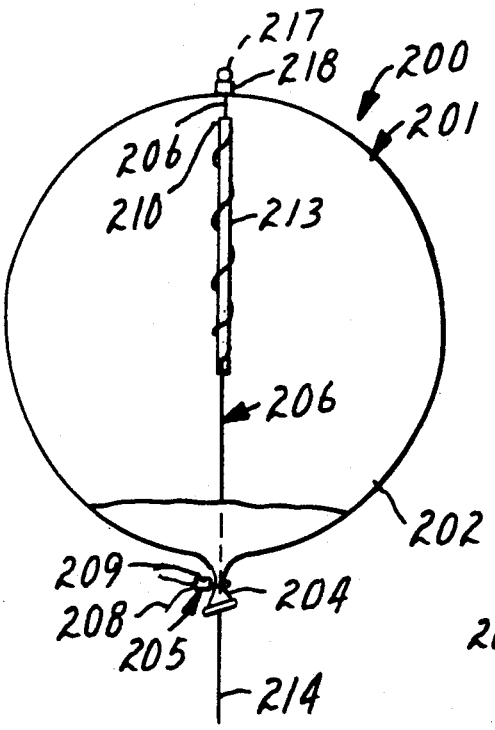
FIG. 11 is a reduced side view of the combination of FIG. 10 shown assembled with a portion of the balloon broken away to show detail.
Figure 10:
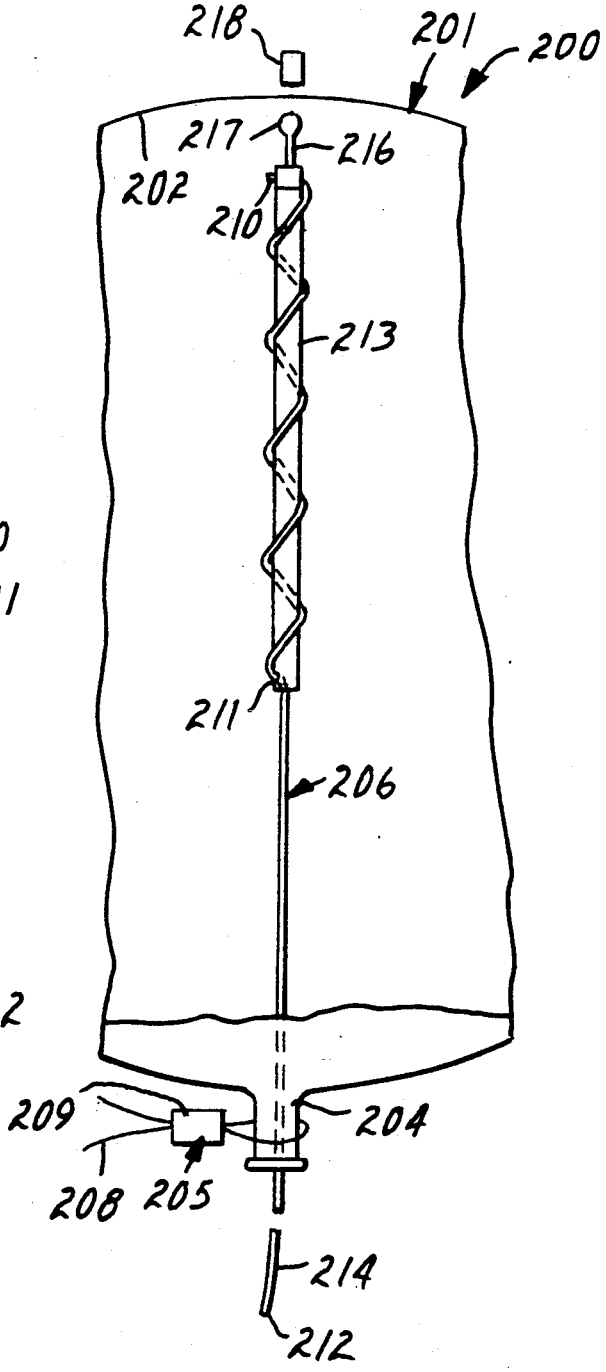
FIG. 10 is a side exploded view of an fifth embodiment of a combination according to the present invention comprising a toy balloon and a light source structure shown partially disassembled and having a portion of the balloon broken away to show detail.

Referring now to FIGS. 10 and 11 of the drawing, there is shown a fifth embodiment of a combination according to the present invention generally designated by the reference numeral 200.

Generally the combination 200 comprises (1) a toy balloon 201 comprising a thin transparent or translucent flexible resiliently stretchable wall 202 having an inner surface defining a cavity and including an inlet portion 204 illustrated closed by a closure assembly 205 that is the same as the closure assembly 223 described above, which inlet portion 204 defines a through inlet opening into the cavity through which gas (e.g., helium) under pressure can be directed into the cavity to inflate the balloon 201; (2) a light source structure 206 which is capable of emitting visible light without the production of significant heat; and (3) means for attaching the light source structure 206 to the wall 202 to support the light source structure 206 generally at a predetermined position with respect to the wall 202. The light source structure 206 is a length of small diameter very flexible transparent polymeric tubing (e.g., 0.05 inch outside diameter, 0.03 inch inside diameter extruded poly vinyl chloride tubing) having first and second ends 210 and 212, a central passageway, and a plurality of the chemical substances described above sealed within the central passageway (e.g., by heat sealing at the ends of the tubing) which chemical substances have been mixed together and are reacting to emit visible light. The means for attaching attaches the first end 210 of the tubing to the wall 202 of the balloon 201 along its inner surface generally opposite the inlet opening, and a portion of the light source structure 206 extends from that portion of the means for attaching helically around a hollow tubular support 213 (e.g., a polymeric soda straw) generally diametrically through the cavity, through a transverse passageway 211 in the end of the tubular support 213 opposite the first end 210 of the tube, and then to and through the inlet opening of the inflated balloon 201. The closure assembly 205 closes the inlet portion 204 of the balloon 201 around a portion of the tubing to provide an additional portion of the means for attaching, and a major end portion 214 of the light source structure 206 from the inlet portion 204 to its second end 212 extends generally radially outside of the cavity in the balloon 201 and serves as a string by which the balloon 201 may be held or tied to a structure.

The portion of the means for attaching that attaches the first end 210 of the tubing to the wall 202 of the balloon 201 comprises a post 216 having first and second ends. One end of the tubular support 213 extends over a portion of the post 216 adjacent its second end and with the tubing is attached thereto by a portion of the tubing adjacent its first end 210 passing through and being adhered in an aligned transverse opening in both the post 216 and the tubular support 213. The first end of the post 216 is defined by a head 217 having a diameter (e.g., ¼ inch) that is larger than a portion of the post 216 adjacent the head 217. The head 217 is positioned adjacent the inner surface of the wall 202 at a portion of the wall 202 generally opposite the inlet portion 204 as illustrated; and a band 218 preferably formed by a ¼ inch long length of polyvinyl chloride tubing having a 0.08 inch inside diameter and an 0.125 inch outside diameter is engaged around the outer surface of that portion of the balloon wall 202 and the portion of the post 216 adjacent the head 217 to attach the head 217 to the wall 202 so that upon a predetermined amount of inflation of the balloon 201 as illustrated, the post 216, tubular support 213, and closure assembly 205 will position the light source structure 206 generally at the predetermined position with respect to the balloon 201.

The present invention has now been described with reference to several embodiments and several modifications thereof. It will be apparent to those skilled in the art that many changes can be made in the embodiments described without departing from the scope of the present invention. Thus the scope of the present invention should not be limited to the structures described in this application, but only by structures described by the language of the claims and the equivalents of those structures.

I claim:

1. In combination, a toy balloon comprising a thin flexible transparent or translucent wall having an inner surface defining a balloon cavity and including an inlet portion defining a through inlet opening into said balloon cavity through which gas under pressure can be directed into said balloon cavity to inflate said balloon;

a light source structure, said light source structure including a light emitting member capable of emitting light without generating a significant amount of heat, a translucent envelope having a predetermined decorative peripheral shape and an envelope cavity within said envelope adapted to receive said light emitting member, and means for retaining said light emitting member within said envelope cavity; and means for supporting said light source structure from said wall generally at a predetermined position in said balloon cavity with respect to said wall when the balloon is inflated.

2. A combination according to claim 1 wherein said means for supporting said light source structure from said wall comprises an resiliently elastic elongate member having first and second ends and a length at least adapted to extend transverse of said balloon cavity when said balloon is inflated, means for attaching said first end of said elastic elongate member to said wall at a position generally opposite said inlet opening with a portion of said elongate member extending through said inlet opening and being under tension, and means for supporting said light source structure from a portion of said elongate member positioned between said first and said inlet opening when said balloon is inflated.

3. A combination according to claim 2 wherein said means for attaching said first end of said elastic elongate member to said wall comprises an attachment member attached to the first end of said elastic elongate member, said attachment member having a head and a smaller portion adjacent said head smaller than said head, said head being positioned adjacent the inner surface of said wall at a portion of said wall; and a member engaged around said portion of said wall and said smaller portion of said attachment member adjacent said head to attach said head to said wall.

4. A combination according to claim 2 wherein said light source member is a light stick including means for producing light by chemical reaction, said translucent envelope has first and second openings to said envelope cavity at opposite ends of said envelope cavity, said elongate member passes through said first opening, said envelope cavity and said second opening with said second opening adjacent the first end of said elastic elongate member, said means for supporting said light source structure from a portion of said elongate member positioned between said first end and said inlet opening when said balloon is inflated comprises a support member attached to said elongate member and positioned in said envelope cavity with said translucent envelope around said second opening being supported from said support member, and said combination includes a flexible sheet positioned in said envelope cavity and adapted to be deflected around the light stick positioned within the envelope cavity when the elongate member is stretched between said enlarged member and said flexible sheet to cover the first opening to the envelope cavity and provide said means for retaining said light source member within said envelope cavity.

5. A combination according to claim 1 wherein said means for attaching said light source structure to said wall comprises a post having first and second ends, means for attaching said first end of said post to said wall at a position generally opposite said inlet opening, and means for supporting said light source structure from a portion of said post adjacent said second end of said post.

6. A combination according to claim 5 wherein said means for attaching said first end of said post to said wall comprises said post having a generally spherical head at said first end and a portion adjacent said head and between said head and said second end having a diameter smaller than said head, said head being positioned adjacent the inner surface of said wall at a portion of said wall; and a member engaged around said portion of said wall and said portion of said post adjacent said head to attach said head to said wall.

7. A combination according to claim 5 wherein said light source member is a light stick including means for producing light by chemical reaction, and said means for supporting said light source structure from a portion of said post adjacent said second end of said post comprises said portion of said post adjacent said second end of said post being enlarged and being received in said envelope cavity with said translucent envelope supported from said enlarged portion, and said post having a socket opening through said second end adapted to frictionally receive an end portion of said light stick to provide said means for retaining said light source member within said envelope cavity.

* * * * *